US006472826B2

(12) United States Patent
Kang et al.

(10) Patent No.: US 6,472,826 B2
(45) Date of Patent: Oct. 29, 2002

(54) METHOD OF DRIVING PLASMA DISPLAY PANEL AND A PLASMA DISPLAY DEVICE USING THE METHOD

(75) Inventors: Kyoung-ho Kang, Asan (KR); Seong-charn Lee, Seoul (KR); Joo-yul Lee, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/848,342

(22) Filed: May 4, 2001

(65) Prior Publication Data

US 2002/0043940 A1 Apr. 18, 2002

(30) Foreign Application Priority Data

Oct. 13, 2000 (KR) ..... 2000-60256

(51) Int. Cl.[7] ..... G09G 3/10
(52) U.S. Cl. ..... 315/169.4; 345/67
(58) Field of Search ..... 315/169.4, 169.1, 315/169.2, 169.3; 345/60, 65, 67

(56) References Cited

U.S. PATENT DOCUMENTS 6,232,935 B1 * 5/2001 Fukushima et al. ..... 345/67
6,256,002 B1 * 7/2001 Shinoda ..... 345/60
6,337,673 B1 * 1/2002 Ide et al. ..... 345/208

FOREIGN PATENT DOCUMENTS

KR 1999-0006730 3/1999

OTHER PUBLICATIONS

U.S. patent application Ser. No. 09/512,874, Kang et al., filed Feb. 25, 2000.

* cited by examiner

*Primary Examiner*—Don Wong
*Assistant Examiner*—Thuy Vinh Tran

(57) ABSTRACT

A method of driving a plasma display panel, where the plasma display panel has opposing front and rear substrates which are spaced facing each other, X and Y electrode lines which are formed in parallel between the front and rear substrates, and address electrode lines formed to be perpendicular to the X and Y electrode lines so that discharge cells are defined by the crossing X and Y electrode lines and the address electrode lines. The method includes periodically applying display pulses to all the X and Y electrode lines, initializing the discharge conditions of a previous sub-field, and forming wall charges at discharge cells to be displayed in a current sub-field are sequentially performed while the display pulses are not applied. A bias pulse having the same polarity as and a lower voltage than the display pulses is applied to all the address electrode lines while the display pulses are applied.

13 Claims, 10 Drawing Sheets

A12
SF1
A1
S1
A11
A13
A14
SAR1..ABn
22a
22b
SX1..X480
23
25
SY1
24
SY2
24
SY480
24
VOLTAGE
TIME

SY1
SY2
SY3
SY4
SY5
SY6
SY7
SY8
SX1..4
SX5..8
SA1..n
GND
100
300
500
400
600
700
800
VOLTAGE
TIME

SY1
SY2
SY3
SY4
SY5
SY6
SY7
SY8
SX1..4
SX5..8
SA1..n
GND
VOLTAGE
TIME

FIG. 11A
FIG. 11B
FIG. 11C
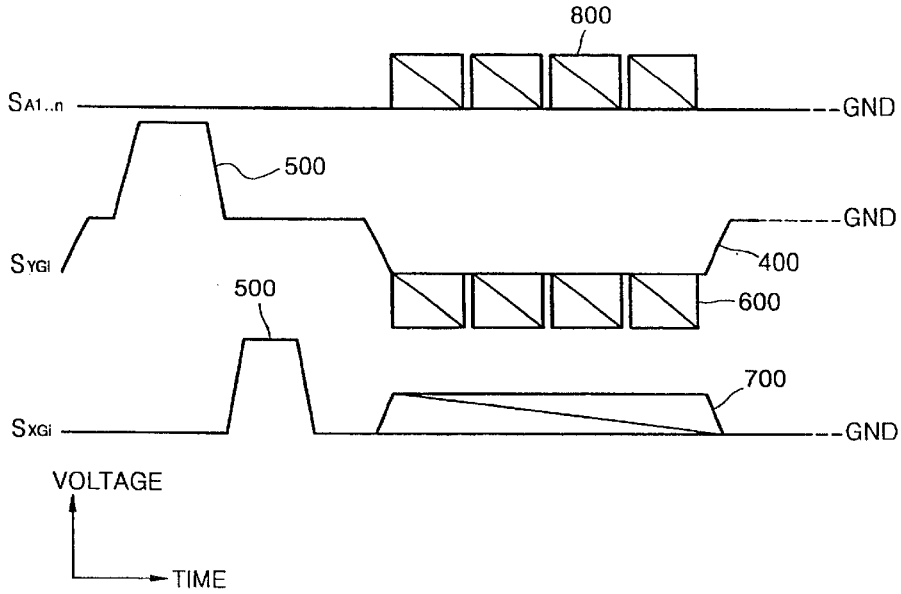
FIG. 12A
FIG. 12B
FIG. 12C
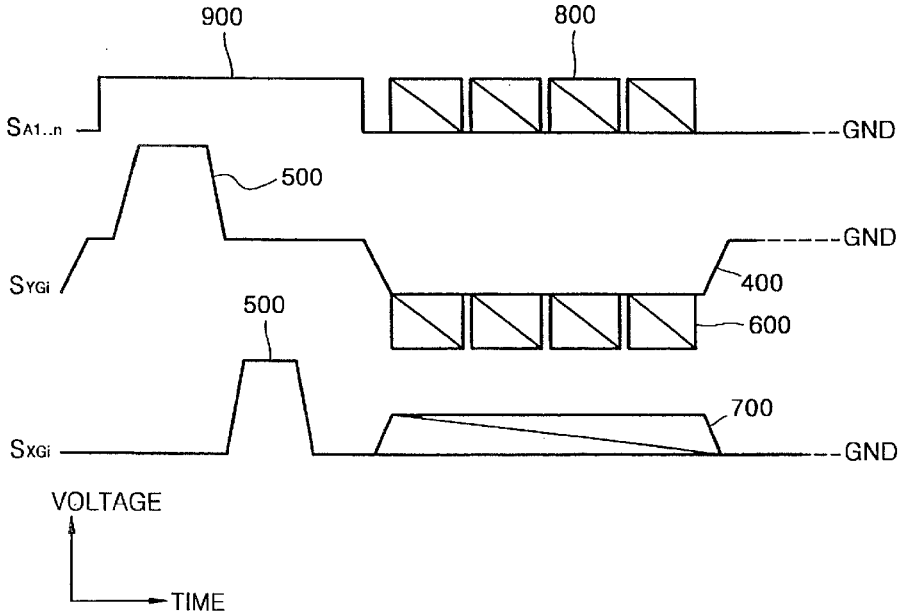

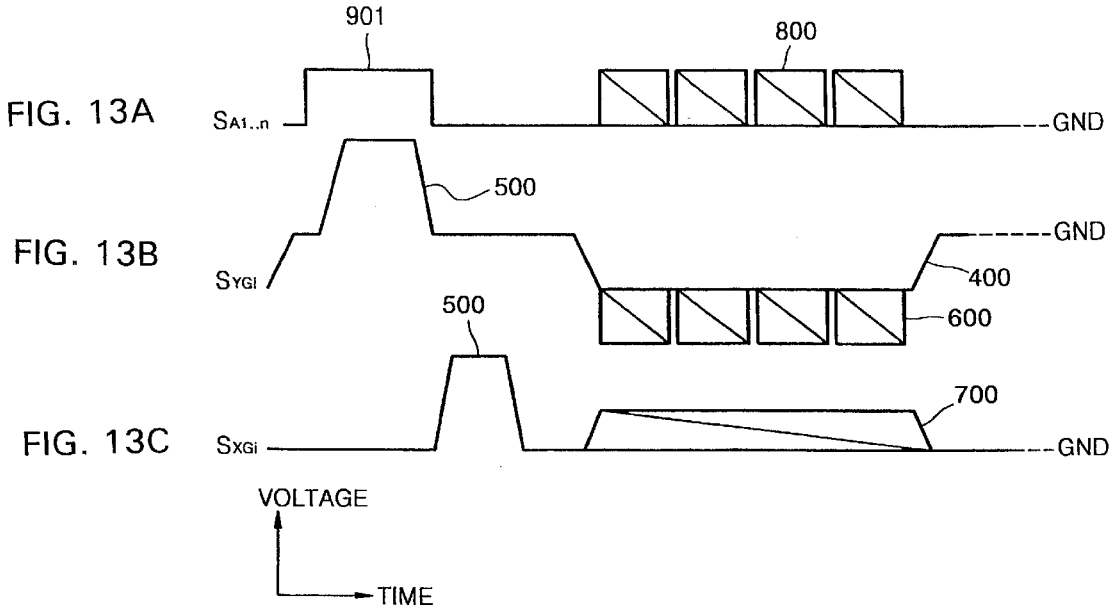
FIG. 13A
FIG. 13B
FIG. 13C
901
800
SA1..n
GND
500
SYGi
GND
400
600
500
700
SXGi
GND
VOLTAGE
TIME
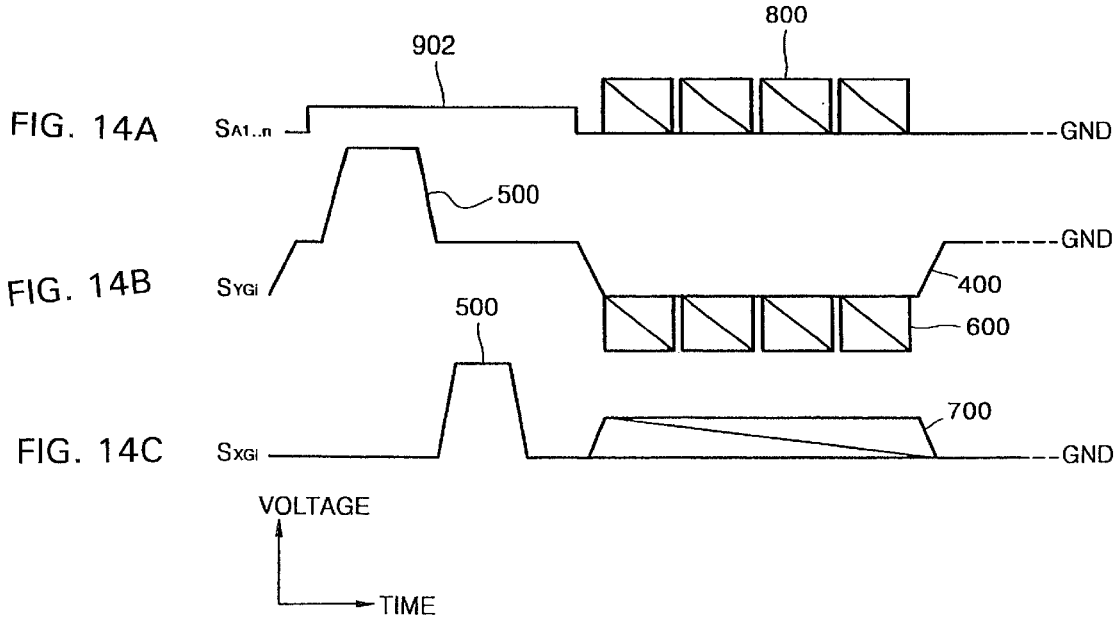
FIG. 14A
FIG. 14B
FIG. 14C
902
800
SA1..n
GND
500
SYGi
GND
400
600
500
700
SXGi
GND
VOLTAGE
TIME

METHOD OF DRIVING PLASMA DISPLAY PANEL AND A PLASMA DISPLAY DEVICE USING THE METHOD

CROSS-REFERENCE TO RELATED APPLICATIONS

This application claims the benefit of Korean Application No. 2000-60256, filed Oct. 13, 2000, in the Korean Industrial Property Office, the disclosure of which is incorporated herein by reference.

BACKGROUND OF THE INVENTION

1. Field of the Invention

The present invention relates to a method of driving a plasma display panel, and more particularly, to an address-while-display driving method of driving an alternating current (AC) type triode surface-discharge plasma display panel.

2. Description of the Related Art

The structures of plasma display panels are largely classified into a counter-discharge structure and a surface-discharge structure depending on the arrangement of discharging electrodes. In addition, methods of driving a plasma display panel are classified into a direct current (DC) driving method and an AC driving method depending on whether the polarity of a driving voltage changes or not.

Referring to FIGS. 1A and 1B, discharge spaces 16 are formed between front glass substrates 10 and 1 and rear glass substrates 20 and 2 in a plasma display panel of DC type counter-discharge structure and a plasma display panel of AC type surface-discharge structure.

Referring to FIG. 1A, in the DC type plasma display panel, a scan electrode 18 and an address electrode 11 are directly exposed to the discharge space 16. Referring to FIG. 1B, in the AC type plasma display panel, display electrodes 3 for performing display are disposed within a dielectric layer 5 so that the display electrodes 3 (x-y electrodes) are electrically separated from the discharge space 16. Here, display is performed by a well-known wall-charge effect. For example, in discharge cells where discharge is provoked between an address electrode 8 and a scan electrode 3*a*, wall charges are formed around the address electrode 8 and the scan electrode 3*a*. Thereafter, a voltage lower than a discharge triggering voltage is applied between the scan electrode 3*a* and a common electrode 3*b* so that display can be performed only in discharge cells where wall charges are formed around the scan electrode 3*a*. Reference numeral 5' denotes a dielectric layer covering the address electrode 8.

Referring to FIG. 2, address electrodes 8, dielectric layers 5 and 5', X-Y electrodes 3, barriers 6 and magnesium monoxide (MgO) layer 9 as a protective layer are provided between a front glass substrate 1 and a rear glass substrate 2 in a usual AC type triode surface-discharge plasma display panel. A metal electrode 4 is used to increase the conductivity of each X-Y electrode 3.

The address electrodes 8 are formed to be parallel on the top surface of the rear glass substrate 2. The rear dielectric layer 5' is deposited on the entire surface of the rear glass substrate 2 having the address electrode lines 8. The barriers 6 are formed on the surface of the rear dielectric layer 5' such that the barriers 6 are parallel to the address electrodes 8. The barriers 6 define the discharge areas of discharge cells and prevent optical cross talk between the discharge cells. A phosphor layer 7 is formed between the barriers 6. The phosphor layer 7 generates light having a color (red, green or blue) corresponding to ultraviolet rays generated due to the discharge of each discharge cell.

The X-Y electrodes 3 are formed on the bottom surface of the front glass substrate 1 such that the X-Y electrodes 3 are perpendicular to the address electrodes 8. The X-Y electrodes 3 cross the address electrodes 8 to form the discharge cells. The front dielectric layer 5 is deposited on the entire bottom surface of the front glass substrate 1 having the X-Y electrodes 3. The MgO layer 9, which protects the display panel from an intensive electric field, is deposited on the entire surface of the front dielectric layer 5. Gas for forming plasma is sealed in a resulting discharge space.

FIG. 3 illustrates a typical address-display separation driving method for the AC type triode surface-discharge plasma display panel of FIG. 2. FIG. 4 illustrates the interconnections between electrodes 3 that perform the driving method of FIG. 3 in the plasma display panel of FIG. 2. Reference numerals 3*a* and 3*b* of FIG. 4 denote the X-Y electrodes 3 of FIG. 2.

Referring to FIGS. 3 and 4, a unit frame (i.e., a unit television field) is divided into 6 sub-fields SF1 through SF6 to realize time division gradation display. In addition, each of the sub-fields SF1 through SF6 is divided into address periods A1 through A6 and display periods S1 through S6.

During each of the address periods A1 through A6, a display data signal is applied to address electrodes $A_{R1}$, $A_{G1}$, $A_{B1}$, . . . , $A_{Gn}$ and $A_{Bn}$, and simultaneously, corresponding scan pulses are sequentially applied to Y electrodes Y1 through Y480. Accordingly, when the display data signal of a high level is applied while scan pulses are being applied, wall charges are formed in corresponding discharge cells due to an address discharge. In discharge cells other than the corresponding discharge cells, wall charges are not formed.

During each of the display periods S1 through S6, a display pulse is alternately applied to all the Y electrodes Y1 through Y480 and the all X electrodes X1 through X480 so that display is performed in discharge cells where wall charges are formed during each corresponding address period A1, . . . or A6. Therefore, the luminance of a plasma display panel is proportional to the time of the display periods S1 through S6 in a unit television field.

Here, the display period S1 of the first sub-field SF1 is set to a time 1T corresponding to $2^0$. The display period S2 of the second sub-field SF2 is set to a time 2T corresponding to $2^1$. The display period S3 of the third sub-field SF3 is set to a time 4T corresponding to $2^2$. The display period S4 of the fourth sub-field SF4 is set to a time 8T corresponding to $2^3$. The display period S5 of the fifth sub-field SF5 is set to a time 16T corresponding to $2^4$. The display period S6 of the sixth sub-field SF6 is set to a time 32T corresponding to $2^5$. Consequently, among the 6 sub-fields SF1 through SF6, a sub-field to be displayed can be appropriately selected so that gradation can be realized.

FIGS. 5A to 5F illustrate driving signals in the unit sub-field SF1 according to the address-display separation driving method of FIG. 3. In FIGS. 5B to 5F, reference character $S_{AR1}, \ldots, {}_{ABn}$ denotes a driving signal applied to the address electrodes $A_{R1}$, $A_{G1}$, . . . , $A_{Gn}$ and $A_{Bn}$ of FIG. 4, reference character $S_{X1}, \ldots, {}_{X480}$ denotes a driving signal applied to the X electrodes X1 through X480 of FIG. 4, and reference character $S_{Y1}, \ldots, {}_{Y480}$ denotes a driving signal applied to the Y electrodes Y1 through Y480 of FIG. 4. Referring to FIG. 5A, the address period A1 in the unit sub-field SF1 is divided into reset periods A11, A12 and A13 and a main address period A14.

During the display period S1, a display pulse 25 is alternately applied to all the Y electrodes Y1 through Y480 and all the X electrodes X1 through X480 so that display is performed in discharge cells where wall charges are formed during the corresponding address period A1. When a final pulse is applied to the X electrodes X1 through X480 during the display period S1, electrons are formed around X electrodes of selected discharge cells for display and positive charges are formed around Y electrodes thereof. Accordingly, during the first reset period, a pulse 22*a* having a lower voltage and larger width than the display pulse 25 is applied to the X electrodes X1 through X480 so that discharging for primarily removing wall charges is performed. In addition, during the second reset period A12, a pulse 23 having the same voltage as and a smaller width than the display pulse 25 is applied to all the Y electrodes Y1 through Y480 to discharge and also remove the remaining wall charges. During the third reset period A13, a pulse 22*b* having a lower voltage and a larger width than the display pulse 25 is applied to the X electrodes X1 through X480 to discharge and finally remove the wall charges. Consequently, all the wall charges can be removed from the discharge space, and space charges can be uniformly distributed.

During the main address period A14, a display data signal is applied to the address electrodes $A_{R1}$, $A_{G1}$, . . . , $A_{Gn}$ and $A_{Bn}$, and simultaneously, a scan pulse 24 is sequentially applied to the Y electrodes Y1 through Y480. For the display data signal applied to each of the address electrodes $A_{R1}$, $A_{G1}$, . . . , $A_{Gn}$ and $A_{Bn}$, a positive polarity voltage Va is applied when selecting a discharge cell, but otherwise, a ground voltage, i.e., 0 V, is applied. A bias voltage of positive polarity is applied to the Y electrodes Y1 through Y480 while scan is not performed, and the scan pulse 24 of 0 V is applied thereto while scan is being performed. Accordingly, when the display data signal is applied while the scan pulse 24 of 0 V is being applied, wall charges are formed in corresponding discharge cells due to address discharge but are not formed in other discharge cells. Here, to realize more accurate and efficient address discharging, a bias voltage lower than that of the display data signal is applied to the X electrodes X1 through X480.

According to such an address-display separation driving method, since the time domains of the sub-fields SF1 through SF6 of FIG. 3 are separated in a unit television field, the time domains of the address period and the display period are separated in each of the sub-fields SF1 through SF6. Accordingly, each pair of X and Y electrodes which have been addressed is in a stand mode until the remaining pairs of X and Y electrodes are all addressed during the address period. Consequently, an address period is longer and a display period is relatively shorter in each sub-field so that the luminance of light emitted from a plasma display panel is lowered.

SUMMARY OF THE INVENTION

To solve the above and other problems, it is an object of the present invention to provide a method of driving a plasma display panel using address-while-display driving method, through which the accuracy of address discharging increases, thereby improving the picture quality of the plasma display panel and decreasing the power consumption thereof.

Additional objects and advantages of the invention will be set forth in part in the description which follows and, in part, will be obvious from the description, or may be learned by practice of the invention.

Accordingly, to achieve the above and other objects of the invention, a method of driving a plasma display panel having opposing front and rear substrates which are spaced facing each other, parallel X and Y electrodes formed between the front and rear substrates, and address electrodes formed to cross the X and Y electrodes so that discharge cells are defined by the crossing X and Y electrodes and the address electrodes, the method according to an embodiment of the present invention including periodically applying display pulses to all the X and Y electrodes, initializing discharge conditions of a previous sub-field, and sequentially forming wall charges at discharge cells to be displayed in a current sub-field while the display pulses are not applied, where a bias pulse having the same polarity as and a lower voltage than the display pulses is applied to all the address electrode lines while the display pulses are applied.

According to an aspect of the present invention, a bias pulse having the same polarity as and a lower voltage than the display pulses is applied to all the address electrodes while the display pulses are applied to reduce movement of space charges from the discharge cells where display discharging is provoked by the display pulses to adjacent other discharge cells (i.e., the probability that address discharging is provoked so as to form wall charges at discharge cells where wall charges should not be formed at the address step can be reduced) so that the accuracy of address discharging is increased in driving a plasma display panel according to an address-while-display driving method, thereby improving the picture quality of the plasma display panel and reducing the power consumption.

According to another aspect of the present invention, the voltage of the bias pulse applied to all the address electrodes is the same as or lower than the voltage of a data pulse which is applied to selected address electrodes during the sequentially forming the wall charges.

According to a yet another aspect of the present invention, the bias pulse is applied to all the address electrodes only while the display pulses are applied to all the Y electrodes, and during the sequentially forming the wall charges, a data pulse is applied to selected address electrodes, and simultaneously, a scan pulse having a polarity opposite to that of the data pulse is applied to a corresponding single Y electrode line so that wall charges are formed at discharge cells to be displayed.

BRIEF DESCRIPTION OF THE DRAWINGS

The above and other objects and advantages of the invention will become more apparent and more readily appreciated from the following description of the preferred embodiments thereof with reference to the attached drawings in which:

FIGS. 11A to 11C are voltage waveform diagrams illustrating driving signals applied during a minimum driving period according to the driving method of FIG. 9;

FIGS. 12A to 12C are voltage waveform diagrams illustrating driving signals applied during a minimum driving period according to the driving method of FIG. 10;

FIGS. 13A to 13C are voltage waveform diagrams illustrating driving signals applied during a minimum driving period in a method according to another embodiment of the present invention; and FIGS. 14A to 14C are voltage waveform diagrams illustrating driving signals applied during a minimum driving period in a method according to yet another embodiment of the present invention.

DETAILED DESCRIPTION OF THE PREFERRED EMBODIMENTS

Figure 1A:
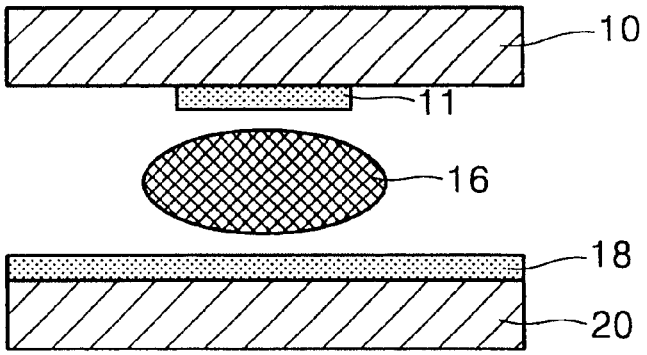
FIG. 1A (PRIOR ART)
FIG. 1A is a cross sectional view illustrating a conventional direct current (DC) type plasma display panel having a counter-discharge structure.
Figure 1B:
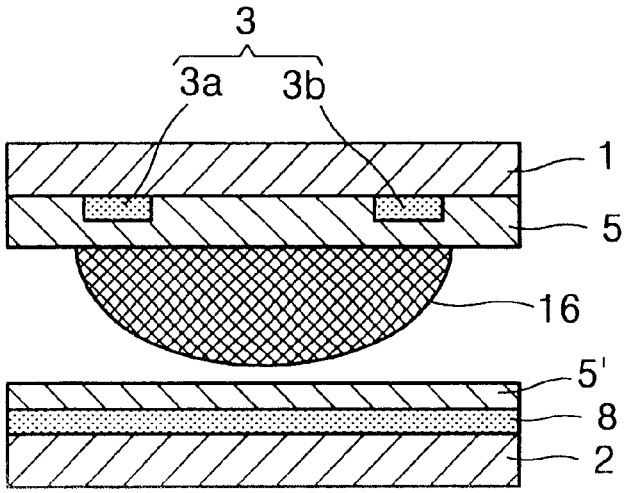
FIG. 1B (PRIOR ART)
FIG. 1B is a cross sectional view illustrating a conventional alternating current (AC) type plasma display panel having and a surface-discharge structure.
Figure 2:
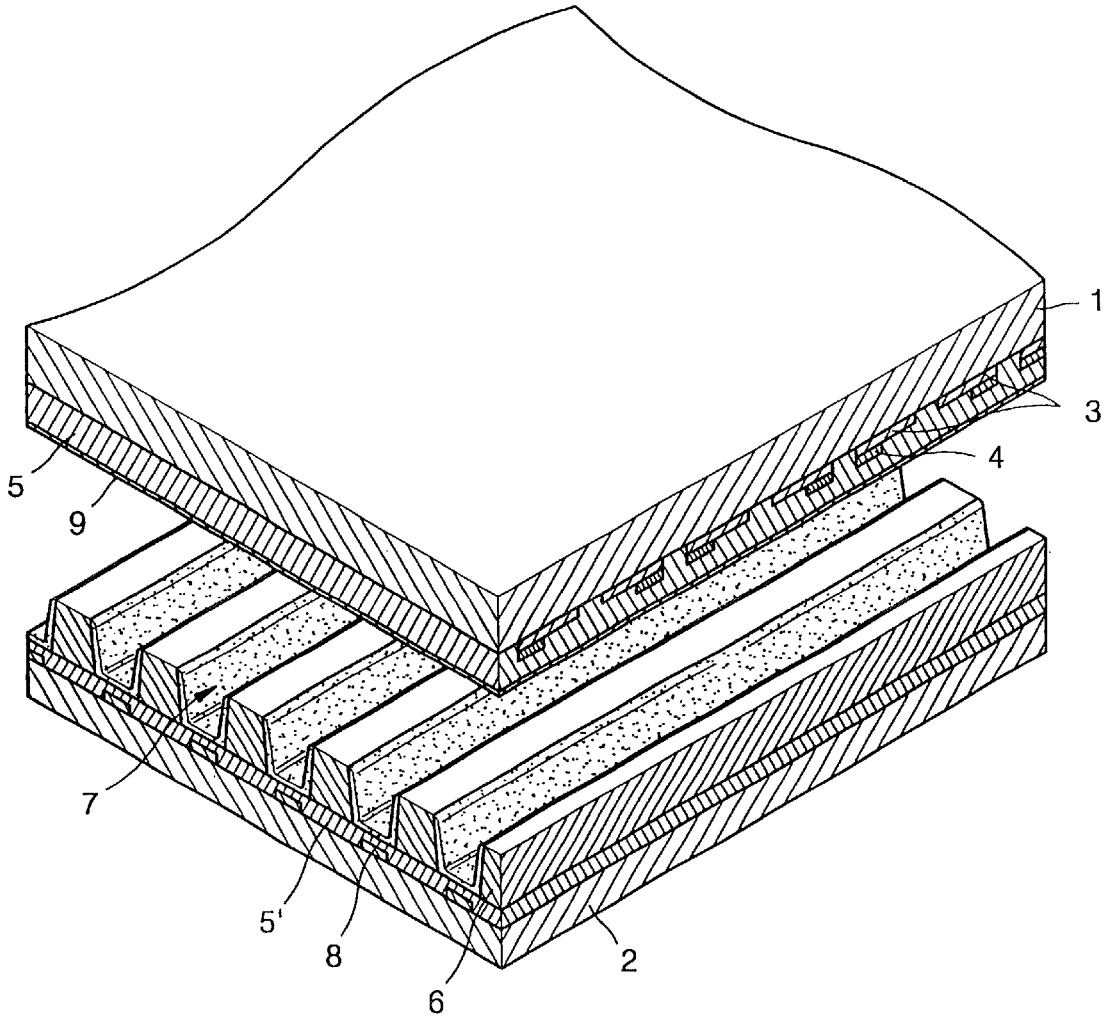
FIG. 2 (PRIOR ART)
FIG. 2 is a perspective view illustrating a conventional AC type triode surface-discharge plasma display panel.
Figure 3:
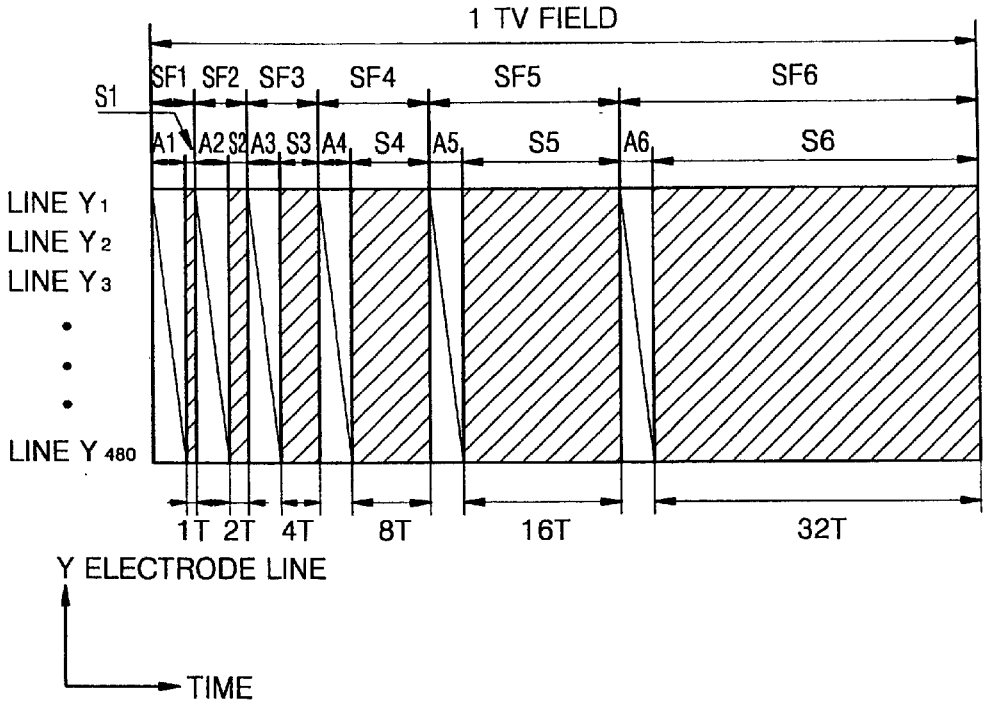
FIG. 3 (PRIOR ART)
FIG. 3. is a timing diagram illustrating a conventional address-display separation driving method for the AC type triode surface-discharge plasma display panel of FIG. 2.
Figure 4:
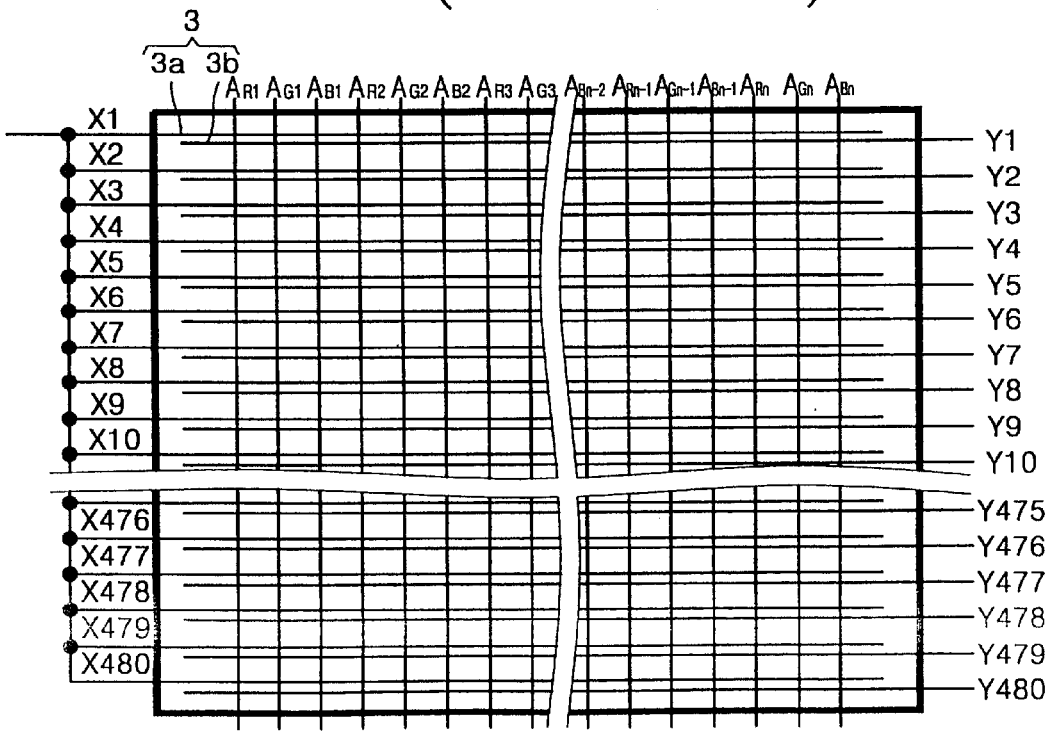
FIG. 4 (PRIOR ART)
FIG. 4 is a diagram illustrating the interconnections between electrodes performing the driving method of FIG. 3 in the plasma display panel of FIG. 2.
Figures 5A, 5B, 5C, 5D, 5E, 5F:
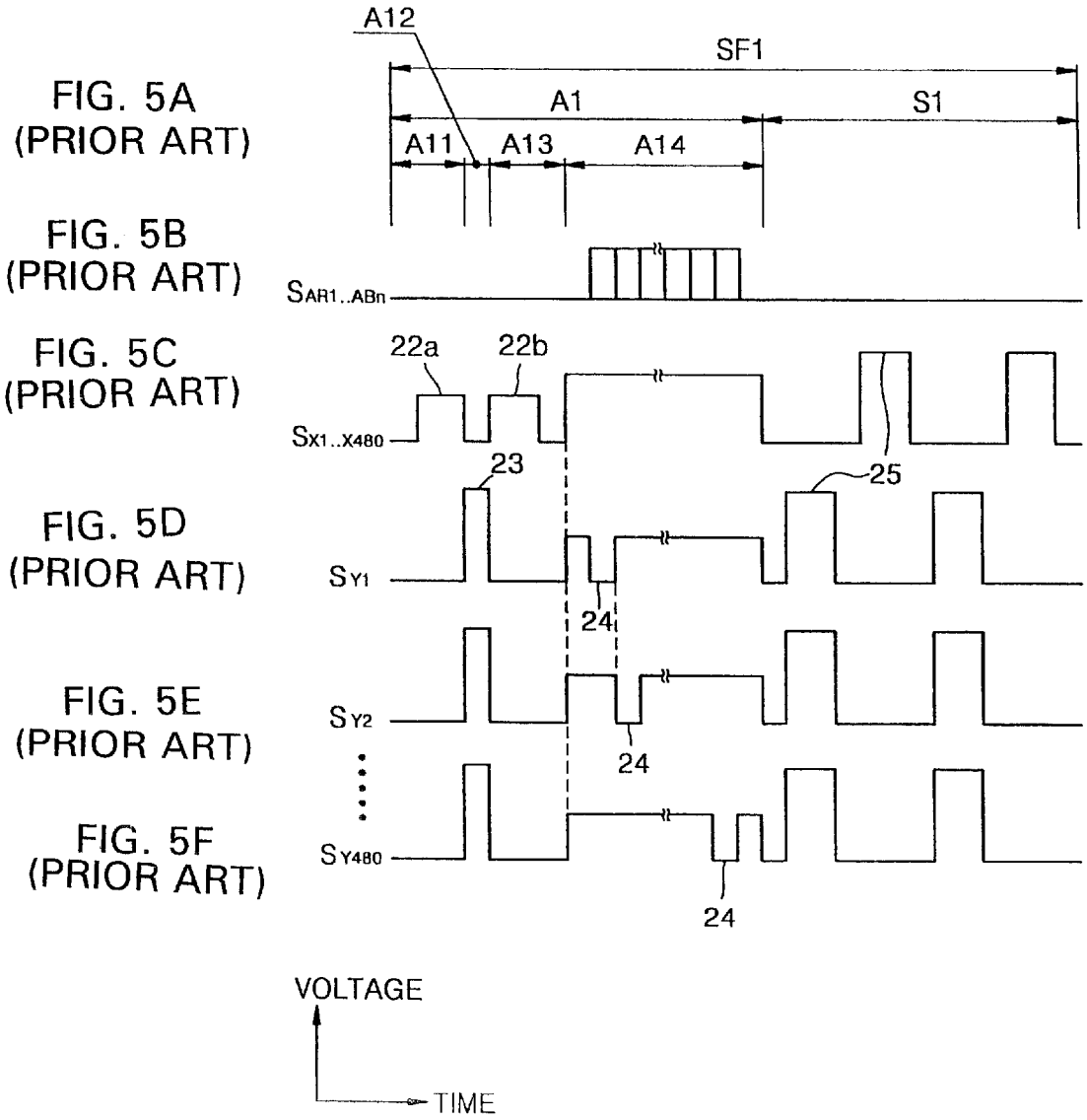
FIG. 5A (PRIOR ART)
FIG. 5B (PRIOR ART)
FIG. 5C (PRIOR ART)
FIG. 5D (PRIOR ART)
FIG. 5E (PRIOR ART)
FIG. 5F (PRIOR ART)
FIGS. 5A to 5F are voltage waveform diagrams illustrating driving signals in a unit sub-field according to the address-display separation driving method of FIG. 3.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 6:
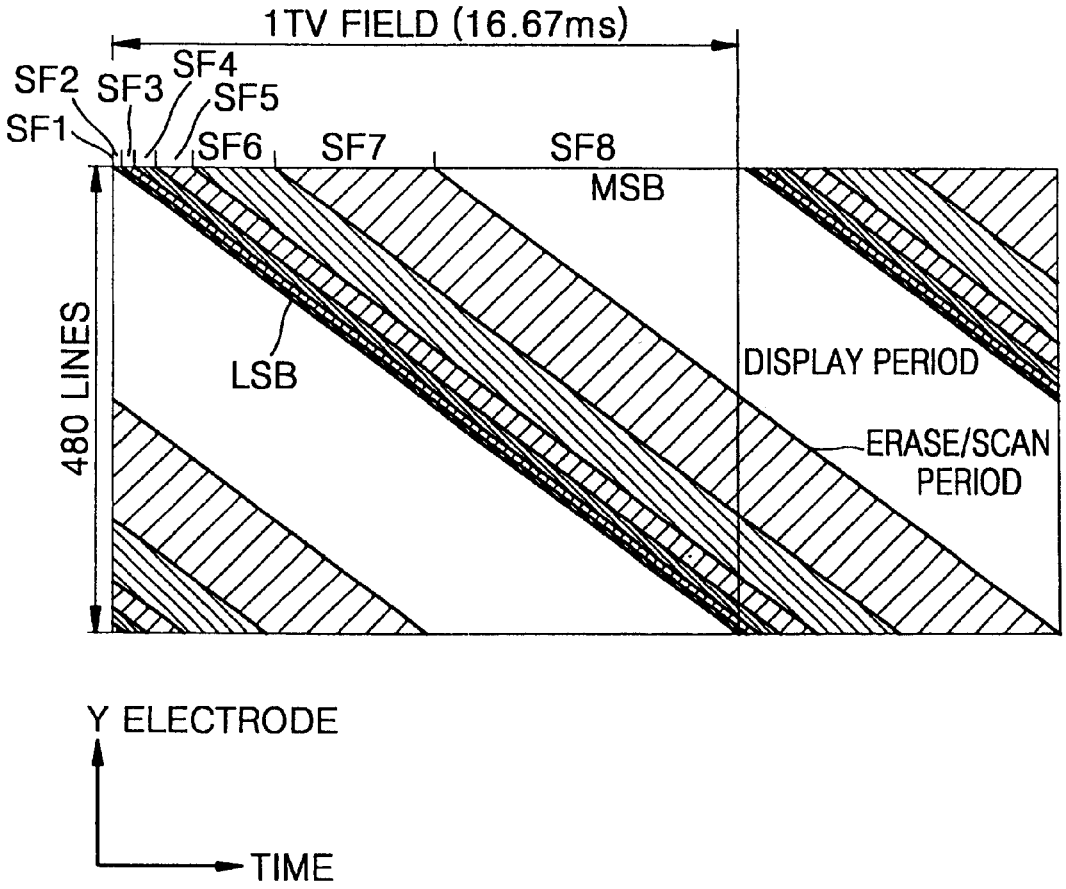
FIG. 6 is a timing diagram illustrating an address-while-display driving method for the AC type triode surface-discharge plasma display panel of FIG. 2.

An address-while-display driving method is shown in FIG. 6. Referring to FIG. 6, a unit television field of 16.67 ms is divided into 8 sub-fields SF1 through SF8 for time division gradation display. Here, since the sub-fields overlap with each other on the basis of the Y electrodes Y1 through Y480 being driven, the time domains of an address period and a display period in each of the sub-fields SF1 through SF8 overlap with each other. Accordingly, each pair of X and Y electrodes can perform display discharging immediately after they are addressed during an address period. Consequently, the address period for the sub-fields SF1 through SF8 is shorter, and the display period therefore is relatively longer, so that the luminance of light emitted from a plasma display panel increases.

Reset, address (or scanning) and display steps are performed for each of the sub-fields SF1 through SF8, and the time assigned to each of the sub-fields SF1 through SF8 is determined by a display time corresponding to gradation. For example, in a case where 256 gradations are displayed using 8-bit image data in each unit television field, when the unit television field is composed of 256 unit times, the first sub-field SF1 driven depending on the least significant bit (LSB) of image data has 1 unit time of $2^0$, the second sub-field SF2 has 2 unit times of $2^1$, the third sub-field SF3 has 4 unit times of $2^2$, the fourth sub-field SF4 has 8 unit times of $2^3$, the fifth sub-field SF5 has 16 unit times of $2^4$, the sixth sub-field SF6 has 32 unit times of $2^5$, the seventh sub-field SF7 has 64 unit times of $2^6$, and the eighth sub-field SF8 driven depending on the most significant bit (MSB) of the image data has 128 unit times of $2^7$. In other words, since the unit times assigned to the respective sub-fields sum up to 257 unit times, 255 gradations can be displayed. Here, when including a gradation which is not displayed in any of the sub-fields, 256 gradations can be displayed.

Figure 7A:
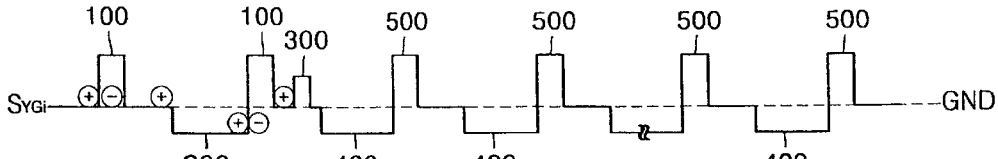
FIGS. 7A and 7B are voltage waveform diagrams illustrating driving signals related to a reset step of a multiple-address-overlapping-display driving method as the address-while-display driving method of FIG. 6.
Figure 7B:
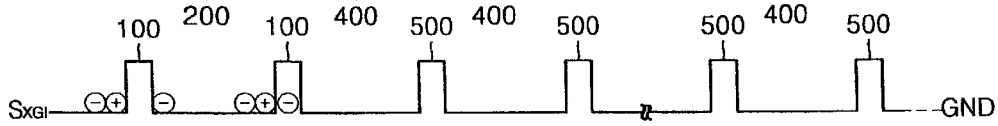
Figure 7B:
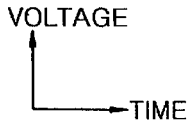
Figure 8A:
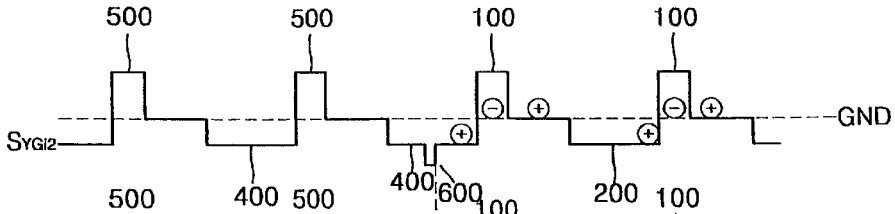
FIGS. 8A to 8C are a voltage waveform diagram illustrating driving signals related to an address step of the multiple address overlapping display driving method of FIGS. 7A and 7B.
Figure 8B:
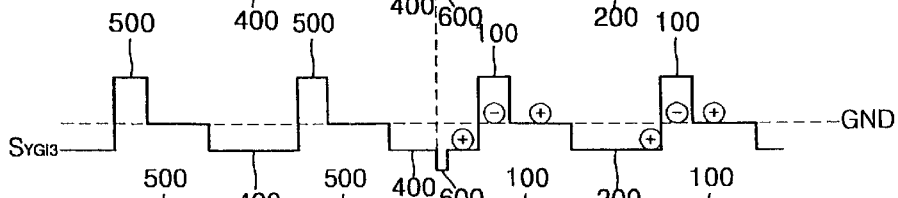
Figure 8C:
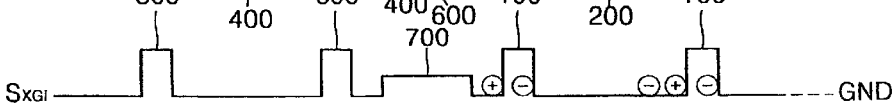
Figure 8C:
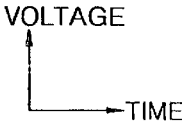
Figures 9A, 9B, 9C, 9D, 9E, 9F, 9G, 9H, 9I, 9J, 9K:
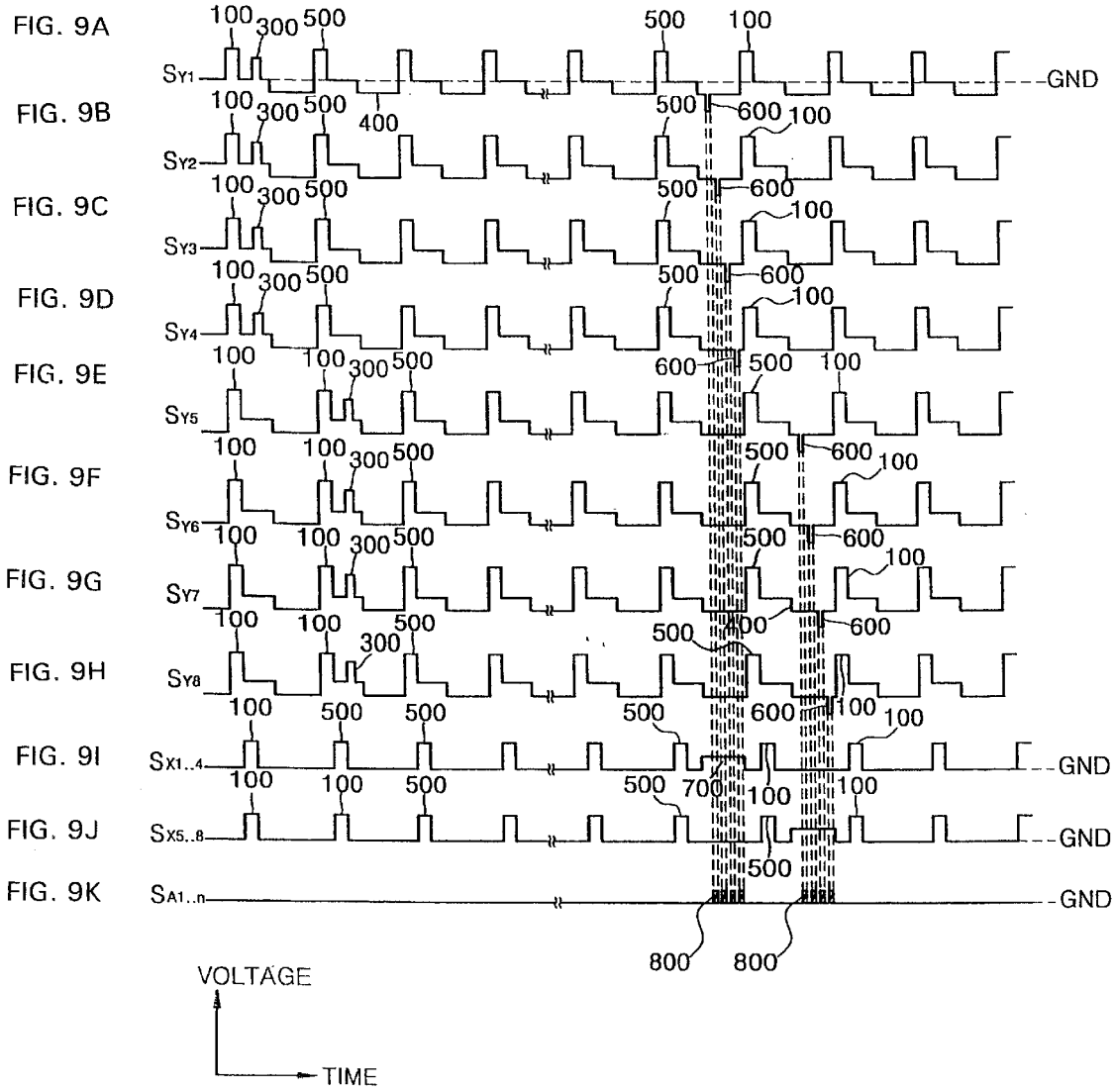
FIGS. 9A to 9K are voltage waveform diagrams illustrating an example in which the driving signals of FIGS. 7 and 8 are applied to an AC type triode surface-discharge plasma display panel.
Figures 10A, 10B, 10C, 10D, 10E, 10F, 10G, 10H, 10I, 10J, 10K:
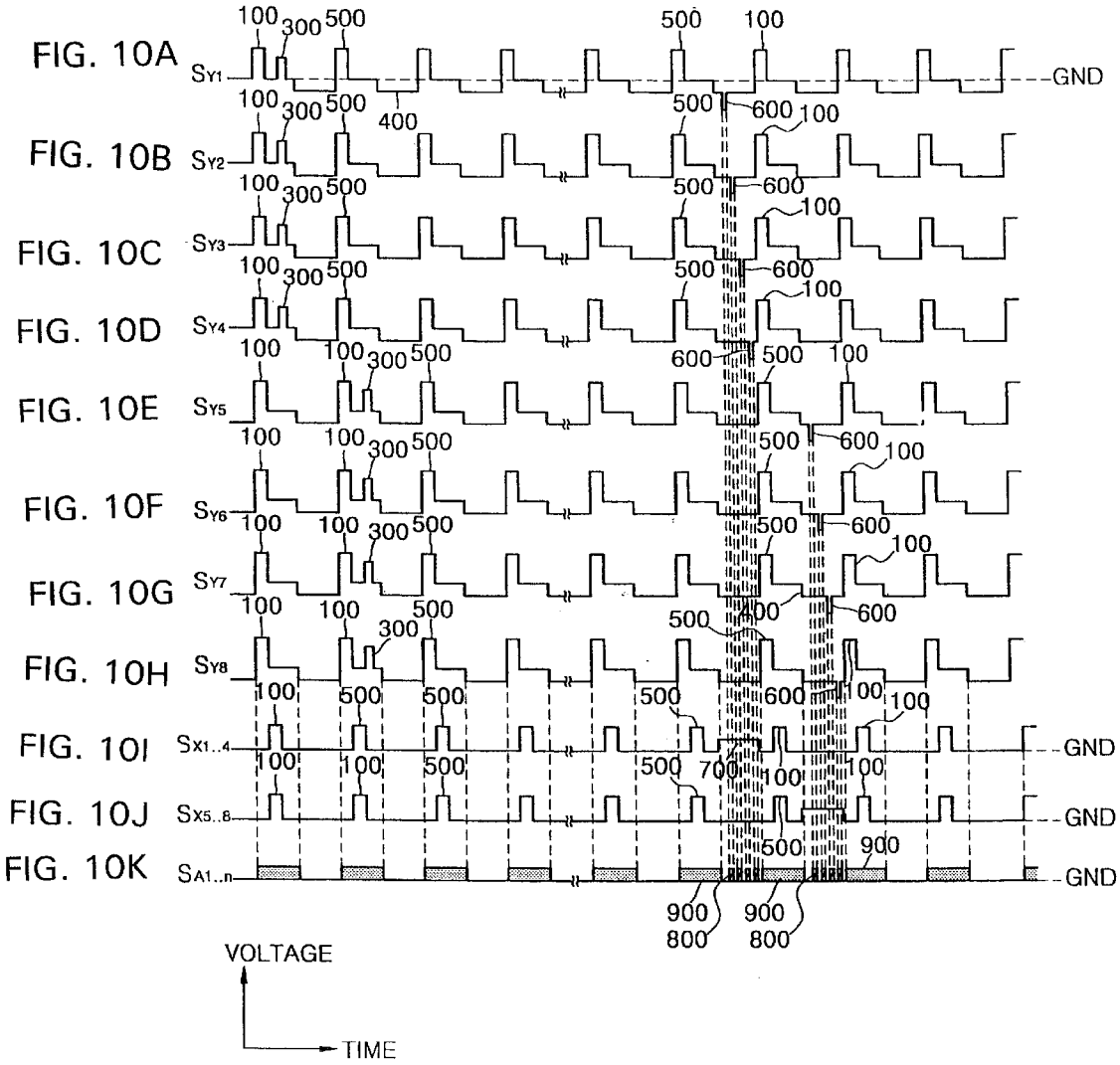
FIGS. 10A to 10K are voltage waveform diagrams illustrating the driving signals of an AC type triode surface-discharge plasma display panel according to an embodiment of the present invention.

FIGS. 7A and 7B illustrate driving signals related to a reset step of a multiple-address-overlapping-display driving method as the address-while-display driving method of FIG. 6. FIGS. 8A to 8C illustrate driving signals related to an address step of the multiple address overlapping display driving method of FIG. 6. FIGS. 9*a* to 9K illustrate an example in which the driving signals of FIGS. 7A and 7B and 8A to 8C are applied to an AC type triode surface-discharge plasma display panel.

In FIGS. 7A and 7B, 8A to 8C and 9A to 9K, a reference character $S_{YGi}$ denotes a driving signal applied to an i-th Y electrode, a reference character $S_{XGi}$ denotes a driving signal applied to an i-th X electrode, reference numerals 100 and 500 denote periodically applied display pulses, reference numerals 200 and 400 denote bias pulses for a smooth switch to a scan voltage, reference numeral 300 denotes a reset pulse for initializing discharging conditions with respect to a previous sub-field, a reference character GND denotes a ground voltage as a reference voltage, a reference character $S_{YGi2}$ denotes a driving signal applied to an i+2nd Y electrode, a reference character $S_{YGi3}$ denotes a driving signal applied to an i+3rd Y electrode, reference numeral 600 denotes a scan pulse, reference numeral 700 denotes a bias pulse applied to corresponding X electrode lines during address periods, reference numeral 800 denotes a display data pulse, reference characters $S_{X1}\ldots_4$ and $S_{X5}\ldots_8$ denote driving signals applied to the groups of X electrodes corresponding to Y electrode lines which are scanned, and a reference character $S_{A1}\ldots_n$ denotes a display data signal applied to Y electrodes which are scanned.

Referring to FIGS. 7A through 9K, the display pulses 100 and 500 are alternately applied to all the Y and X electrodes one time during adjacent minimum display periods. A minimum reset period and a minimum address period appear between the minimum display periods. In other words, the minimum reset and address periods appear at the pause of sustained discharging.

During a minimum address period, the scan pulse 600 is applied to Y electrodes corresponding to 4 sub-fields, and simultaneously, a corresponding display data signal $S_{A1}\ldots_n$ is applied to each address electrode. Reference characters $S_{Y1}$ through $S_{Y8}$ denote Y electrode driving signals applied to Y electrodes corresponding to the first through eighth sub-fields SF1 through SF8 of FIG. 6. More specifically, $S_{Y1}$ denotes a driving signal applied to a certain Y electrode of the first sub-field SF1, $S_{Y2}$ denotes a driving signal applied to a certain Y electrode of the second sub-field SF2, $S_{Y3}$ denotes a driving signal applied to one Y electrode of the third sub-field SF3, $S_{Y4}$ denotes a driving signal applied to one Y electrode of the fourth sub-field SF4, $S_Y$5 denotes a driving signal applied to one Y electrode of the fifth sub-field SF5, $S_{Y6}$ denotes a driving signal applied to one Y electrode of the sixth sub-field SF6, $S_{Y7}$ denotes a driving signal applied to one Y electrode of the seventh sub-field SF7, and $S_{Y8}$ denotes a driving signal applied to one Y electrode of the eighth sub-field SF8.

During each minimum display period, the display discharge pulses 100 and 500 are alternately applied to the X and Y electrodes so that display discharging can be provoked at pixels where wall charges have been formed. During each minimum reset period, the reset pulse 300 is applied to Y electrodes to be scanned during a succeeding address period during which the remaining wall charges are removed from a previous sub-field and space charges are formed. During minimum address periods, the scan pulse 600 is sequentially applied to Y electrodes corresponding to the 4 sub-fields, and simultaneously, during each minimum address period, the display data signal $S_{A1}\ldots_n$ is applied to each address electrode line, thereby forming wall charges in pixels to be displayed.

Since the pause exists between application of the reset pulse 300 and the application of the scan pulse 600, space charges can be uniformly distributed in a corresponding pixel area. The display pulses 500 which are applied during each pause do not provoke discharge for display, but uniformly distribute space charges in a corresponding pixel area. However, the display pulses 100 which are applied during the time except the pause provoke discharge for display at pixels where wall charges are formed by the scan pulse 600 and the display data pulse 800.

Addressing is performed four times during the minimum address period between application of the last pulse among the display pulses 500, which are applied during a pause, and a first display pulse 100 succeeding the last display pulse 500. After the display pulses 100 and 500 are simultaneously applied to the Y electrodes, the display pulses 100 and 500 are simultaneously applied to the X electrodes. During the minimum address period between application of the display pulses 100 and 500 to the X electrodes and application of the display pulses 100 and 500 to the Y electrodes, the scan pulses 600 and the display data pulses 800 corresponding to the scan pulses 600 are applied.

According to such the address-while-display driving method, display pulses are periodically applied to all X electrodes and all Y electrodes, and reset and address steps are sequentially performed during a time when the display pulses are not applied. Due to a series of these operations, the probability that space charges move from selected discharge cells (i.e., those discharge cells selected for display discharging) to adjacent non-selected discharge cells is high. Accordingly, the probability that address discharging occurs to form wall charges in non-selected discharge cells where wall charges should not be formed at an address step is high. In this case, non-selected discharge cells, which are not supposed to perform display discharging, perform display discharging, which degrades the picture quality of a plasma display panel and increases power consumption.

In FIGS. 10A to 10K, the signals having the same reference numerals as those in the method disclosed in FIGS. 9A to 9K denote the same signals, and thus a redundant description of these same signals in FIGS. 10A to 10K will be omitted. Referring to FIGS. 10A to 10K. the display pulses 100 and 500 are periodically applied to all X and Y electrodes. A reset step of initializing the discharge conditions of a previous sub-field and an address step of forming wall charges at discharge cells to be displayed in a current sub-field are sequentially performed during a time while the display pulses 100 and 500 are not applied. During the time while the display pulses 100 and 500 are applied, a bias pulse 900 which has the same polarity as and a lower voltage than the display pulses 100 and 500 is applied to all address electrodes.

As a result, the probability is reduced that space charges will move from selected discharge cells where display discharging is provoked to adjacent non-selected discharge cells due to the display pulses 100 and 500. In other words, the probability that address discharging is provoked so as to form wall charges at discharge cells where the wall charges are not supposed to be at the address step can be reduced. Consequently, the accuracy of address discharging is increased in driving a plasma display panel according to an address-while-display driving method, thereby improving the picture quality of the plasma display panel and reducing the power consumption.

On the other hand, when a bias pulse is not applied to all address electrodes during a time while the display pulses 100 and 500 are applied like the driving method as shown in FIGS. 9A to 9K and 11A to 11C, the following phenomenon can occur. In FIGS. 7A and 7B, 9A to 9K, and 11A to 11C, the same numerals denote the same signals. Display discharging is performed at selected discharge cells of a pair of i+1st X and Y electrodes by the display pulse 100 of positive polarity, which is applied to a Y electrode. Simultaneously, when the display pulses 100 and 500 of positive polarity are applied to the discharge cells of an adjacent pair of i-th X and Y electrodes, most electrons around the X electrode of each selected discharge cell of the pair of the i+1st X and Y electrodes move toward the Y electrode thereof, but some electrons move toward the Y electrode of each discharge cell of the pair of the i-th X and Y electrodes. Subsequently, when an address period for the pair of the i-th X and Y electrodes starts after the display pulses 100 and 500 are applied to all the X electrodes, address discharging may be performed at discharge cells where discharging is not supposed to be performed since wall charges are formed due to high potential of negative polarity of the Y electrodes of the discharge cells even if the data pulse 800 of positive polarity is not applied to the address electrodes thereof. In other words, undesired address discharging is provoked at unselected discharge cells, and wall charges of positive polarity are formed around the Y electrodes of the unselected discharge cells, so a succeeding application of the display pulse 500 may cause undesirable display discharging to be achieved.

However, when the bias pulse 900 having the same polarity as and a lower voltage than the display pulses 100 and 500 is applied to all the address electrodes while the display pulses 100 and 500 are applied to all the X and Y electrodes according to the driving method of FIGS. 10A to 10K, the probability is reduced that space charges will move from selected discharge cells where display discharging is provoked to adjacent other, non-selected discharge cells due to the display pulses 100 and 500. This will be described in detail below.

FIGS. 12A to 12C illustrate driving signals applied during a minimum driving period according to the driving method of FIGS. 10A to 10K in detail. In FIGS. 12A to 12C, a reference character $S_{A1}\ldots_n$ denotes a display data signal corresponding to a Y electrode which is scanned, a reference character $S_{YGi}$ denotes a driving signal applied to an i-th Y electrode, and a reference character $S_{XGi}$ denotes a driving signal applied to an i-th X electrode. Reference numeral 400 denotes a scan bias pulse which is applied to a Y electrode, reference numeral 500 denotes a display pulse, reference numeral 600 denotes a scan pulse, reference numeral 700 denotes a scan bias pulse which is applied to an X electrode, and reference numeral 800 denotes a data pulse which is applied to selected address electrodes.

Referring to FIGS.10A to 10K and 12A to 12C, the bias pulse 900 having the same polarity and voltage as the display pulses 100 and 500 is applied to all the address electrodes while the display pulses 100 and 500 are applied. Accordingly, display discharging is performed at selected discharge cells of a pair of i+1st X and Y electrodes by the display pulse 100 of positive polarity which is applied to each Y electrode. Simultaneously, when the display pulses 100 and 500 of positive polarity are applied to the discharge cells of an adjacent pair of i-th X and Y electrodes, most electrons around the X electrode of each selected discharge cell of the pair of the i+1st X and Y electrode lines move toward the Y electrode thereof, and some of the electrons, which are supposed to move toward the Y electrode of each discharge cell of the pair of the i-th X and Y electrode lines, move toward the address electrode. Subsequently, when an address period for the pair of the i-th X and Y electrodes starts after the display pulses 100 and 500 are applied to all the X electrodes, the data pulse 800 of positive polarity is not applied to the address electrodes of discharge cells where wall charges are not supposed to be formed, and the potential of negative polarity of the Y electrodes of the discharge cells is not very high, so address discharging is not performed. In other words, undesired address discharging does not occur at unselected discharge cells, and wall charges of positive polarity are not formed around the Y electrodes of the unselected discharge cells, so a succeeding application of the display pulse 500 does not cause undesirable display discharging.

FIGS. 13A to 13C illustrate driving signals applied during a minimum driving period in a method according to another embodiment of the present invention. In FIGS. 12A to 12C and 13A to 13C, the same reference numerals denote the same signals. When FIGS. 13A to 13C is compared with FIGS. 12A to 12C, a bias pulse 901 of positive polarity is applied to all address electrodes only while the display pulse 500 is applied to all Y electrodes. The operation according to the driving method of FIGS. 13A to 13C is otherwise the same as that described with reference to FIGS. 12A to 12C.

FIGS. 14A to 14C illustrate driving signals applied during a minimum driving period in a method according to yet another embodiment of the present invention. In FIGS. 12A and 12C and 14A to 14C, the same reference numerals denote the same signals. When FIGS. 14A to 14C is compared with FIGS. 12A to 12C and 13A to 13C, a bias pulse 902 having the same polarity as and a lower voltage than the display pulse 500 is applied to all address electrodes while the display pulses 500 are applied to all X and Y electrodes. The operation according to the driving method of FIGS. 14A to 14C is otherwise the same as that described with reference to FIGS. 12A to 12C.

As described above, in a method of driving a plasma display panel according to the present invention, a bias pulse having the same polarity as and a lower voltage than the display pulses is applied to all address electrodes while the display pulses are applied. Accordingly, the probability is reduced that the space charges at selected discharge cells (i.e., the discharge cells where display discharging is provoked by the display pulses) will move toward adjacent other non-selected discharge cells. In other words, the probability that address discharging is provoked so as to form wall charges at discharge cells where wall charges should not be formed at the address step can be reduced. Consequently, the accuracy of address discharging is increased in driving a plasma display panel according to an address-while-display driving method, thereby improving the picture quality of the plasma display panel and reducing the power consumption.

The present invention is not restricted to the above particular embodiments, but it would be apparent to one of ordinary skill in the art that modifications may be made in the embodiments without departing from the spirit and scope of the invention, the scope of which is defined in the claims and their equivalents.

What is claimed is:

1. A method of driving a plasma display panel having opposite front and rear substrates, parallel X and Y electrodes formed between the front and rear substrates, and address electrodes formed to cross the X and Y electrodes to define discharge cells, the method comprising:

periodically applying display pulses to the X and Y electrodes;

sequentially initializing discharge conditions of a previous sub-field;

forming wall charges at discharge cells to be displayed in a current sub-field while the display pulses are not applied; and applying a bias pulse having the same polarity as and a lower voltage than the display pulses to the address electrodes during said applying the display pulses.

2. The method of claim 1, wherein the voltage of the bias pulse applied to the address electrodes is the same as or lower than the voltage of a data pulse which is applied to selected address electrodes during said forming the wall charge.

3. The method of claim 1, wherein:

the bias pulse is applied to the address electrodes only while the display pulses are applied to all the Y electrodes; and said forming the wall charges further comprises applying a data pulse to selected address electrodes while applying a scan pulse having a polarity opposite to a polarity of the data pulse to a corresponding one of the Y electrodes so that the wall charges are formed at the discharge cells to be displayed.

4. A method of driving a plasma display panel, comprising:

alternately applying display pulses to X and Y electrodes in a current sub-field, where the X and Y electrodes are disposed parallel to each other on a front panel; and applying a bias pulse to address electrodes during said alternately applying the display pulses, where the bias pulse has the same polarity as the display pulses, the address electrodes are disposed on a back panel opposite to and not parallel with the X and Y electrodes, and the back panel is disposed opposite the front panel to form a discharge space.

5. The method of claim 4, further comprising sequentially initializing discharge conditions of a previous sub-field by applying a reset pulse to the Y electrodes.

6. The method of claim 5, further comprising forming wall charges at discharge cells to be displayed in the current sub-field by applying pulses to the Y electrodes and the address electrodes while applying another bias pulse having an opposite polarity to the X electrodes, wherein the discharge cells are defined by where the address electrodes cross the X and Y electrodes, and the voltage of the bias pulse is equal to or less than the voltage of the pulses applied to the address electrodes during said forming the wall charges.

7. The method of claim 4, wherein the bias pulse is not applied to the address electrodes while the display pulses are applied to the X electrodes.

8. The method of claim 4, further comprising forming wall charges at discharge cells to be displayed in the current sub-field by applying pulses to the Y electrodes and the address electrodes while applying another bias pulse having an opposite polarity to the X electrodes, wherein the discharge cells are defined by where the address electrodes cross the X and Y electrodes, and the voltage of the bias pulse is equal to or less than the voltage of the pulses applied to the address electrodes during said forming the wall charges.

9. A plasma display device, comprising:

a front panel comprising parallel X and Y electrodes, and a front dielectric layer that covers the X and Y electrodes;

a back panel disposed opposite said front panel as to define a discharge space, said back panel comprising address electrodes disposed to not be parallel with the Y electrodes to form discharge cells with corresponding ones of the X and Y electrodes, a back dielectric layer that covers the address electrodes, barriers disposed on the back dielectric layer to not cross the address electrodes, and phosphor layers disposed between corresponding pairs of the barriers; and a gas disposed in the discharge space, wherein display pulses are alternately applied to the X and the Y electrodes in a current sub-field to form a display discharge, and a bias pulse is applied to the address electrodes while the display pulses are applied to the X and Y electrodes to form the display discharge, the bias pulse having the same polarity as the display pulses.

10. The plasma display device of claim 9, wherein the bias pulse is not applied to the address electrodes while the display pulses are applied to the X electrodes.

11. The plasma display device of claim 10, wherein a reset pulse is sequentially applied to the Y electrodes to initialize discharge conditions in a previous sub-field, and pulses are applied to the Y electrodes and the address electrodes while another bias pulse having an opposite polarity is applied to the X electrodes to form wall charges at ones of the discharge cells to be displayed in the current sub-field.

12. The plasma display device of claim 9, wherein a reset pulse is sequentially applied to the Y electrodes to initialize discharge conditions in a previous sub-field, and pulses are applied to the Y electrodes and the address electrodes while another bias pulse having an opposite polarity is applied to the X electrodes to form wall charges at ones of the discharge cells to be displayed in the current sub-field.

13. The plasma display device of claim 12, wherein the voltage of the bias pulse is equal to or less than the voltage of the pulses applied to the address electrodes to form the wall charges.

* * * * *